US005287657A

United States Patent [19]

Tschida et al.

[11] Patent Number: 5,287,657

[45] Date of Patent: Feb. 22, 1994

[54] SKATE SHARPENING MACHINE AND METHOD

[75] Inventors: Rudolph R. Tschida, Anoka; Donald Norqual, Roseville, both of Minn.

[73] Assignee: Contract Design, Inc., Minneapolis, Minn.

[21] Appl. No.: 887,684

[22] Filed: May 22, 1992

[51] Int. Cl.[5] ..... B24B 53/06; B24B 9/04

[52] U.S. Cl. ..... 51/5 D; 51/92 BS; 51/94 R; 51/96; 51/91 BS

[58] Field of Search ..... 51/91 R, 91 BS, 91 HK, 51/92 R, 92 BS, 92 HK, 94 R, 96, 158, 159, 160, 217 S, 218 R, 222, 234, 5 D, 74 R

[56] References Cited

U.S. PATENT DOCUMENTS

| | | | |
|---|---|---|---|
| 3,735,533 | 5/1973 | Salberg | 51/34 |
| 3,789,551 | 2/1974 | Norris et al. | 51/92 |
| 3,827,185 | 8/1974 | Smith | 51/5 |
| 3,988,124 | 10/1976 | Babcock | 51/96 |
| 4,055,026 | 10/1977 | Zwicker | 51/228 |
| 4,235,050 | 11/1980 | Hannaford et al. | 51/34 |
| 4,534,134 | 8/1985 | Consay et al. | 51/96 |
| 4,558,541 | 12/1985 | Consay | 51/281 |
| 5,127,194 | 7/1992 | Jobin | 51/5 D |

*Primary Examiner*—Jack Lavinder

*Attorney, Agent, or Firm*—Kinney & Lange

[57] ABSTRACT

A machine for sharpening skates that can be operated by an individual through a coin-operated or credit card operated input, permits a person that wants skates sharpened to place the skate into the machine and have it automatically sharpened in a manner that is selected by the operator. The operator places a skate into a support and the machine centers and clamps the blade. The machine includes a grinding wheel that is dressed before each sharpening operation, to provide a wheel surface that gives the proper shape to the bottom surface of the ice skate blade, and after dressing, a skate held in the clamp is moved across the wheel so the bottom edge surface of the ice skate is sharpened uniformly along its operable length. The machine includes inputs so that either figure skates or hockey-style skates can be sharpened, and positive clamps that hold the blade directly during its sharpening operation. An access door for operators to put in skates is also interlocked so that operation cannot commence until the door is fully closed. The various operations are controlled primarily with fluid-pressure actuators, and the skate itself is centered in its position on the cradle support prior to clamping so that it is properly positioned for complete grinding across the bottom surface.

13 Claims, 16 Drawing Sheets

5
5
66
63
61
83
68
64
70B
72C
64D
22
70A
71A
72A 76
75
71B
72B
72C
75
75A
64
64A
74A
80
70B
61
58
63
34
83
20
61
62D
62C
62
70A
64B
73
72A
71A 30
38
38
42
44C
44A
44
44F
44C
44B
36
46
9
9
46A
52
47
52
46A
102
58
50
56
50
54
58
100
103
106
106
101
101
95
94
8
8
122
110
122C
110
108
108
120
121
93
93
120

122C
122A 122B
122
135I
112
135H
112
108
114
50
50
120
115
116
118
106
118
116
106A
106A
103
106
118
118
116
110
120
114
108
112
115
115A
112

SKATE SHARPENING MACHINE AND METHOD

BACKGROUND OF THE INVENTION

The present invention relates to a machine for automatically sharpening blades of ice skates under controlled, repeatable conditions.

Typical machines and methods for sharpening ice skates are shown in U.S. Pat. Nos. 4,534,134; 4,558,541 and 4,235,050. These machines, while permitting automatic sharpening of ice skates once the skates are clamped in position, have drawbacks in positioning and clamping of the skates, as well as the inability to select for either hollow grind or flat ground skate blade bottom edges.

An earlier machine for skate sharpening which moved the skates along a generally linear path with two skates arranged heel to heel is shown in U.S. Pat. No. 3,735,533. This machine was capable of being set to grind either figure skates or hockey skates.

U.S. Pat. No. 4,235,050 illustrates a skate sharpening machine for grinding the skate blades in a manner to compensate for the normal convex configuration of the blades from end to end, by providing a different biasing force for the wheel at the ends of the cut. The change in bias is controlled by sensing means that detect the grinding resistance of the work piece on the grinding wheel, so that when the grinding resistance decreases the biasing means will make an appropriate adjustment.

SUMMARY OF THE INVENTION

The present invention provides an ice skate sharpening machine which will receive an ice skate having a blade to be sharpened, and make necessary adjustments for the centering of the skate blade. After positioning, the skate is clamped into position and the bottom edge is then ground with a bottom edge surface configuration that is either flat or hollow ground, according to operator selection. The skate is moved through an arc across the grinding wheel and the ice skate blade is sharpened without grinding away the heel and toe region of the blades. The grinding wheel is controlled to ensure complete sharpening of hockey skate blades, as well as figure skate blades. The machine adjusts for figure skate blades (after operator selection) to avoid damaging the serrated leading tip of the blades on figure skates.

The skate sharpening machine is adapted to be coin-operated, or credit card operated so that it can be used by an individual needing a sharpening job merely by placing the correct amount of money in an input device that energizes the machine for its cycle of operation. The ice skate is positively positioned in a known, centered position. Before each cycle of the skate sharpening machine the wheel that is used for grinding the edge surface is dressed to conform to the desired shape of the bottom surface, that is either hollow ground (concave) or flat.

The machine has an outer frame and cabinet with an access door that is made to open when the machine is energized, and which is closed during the sharpening sequence. The door is interlocked to prevent the sharpening sequence from starting until the door is positively closed. The sliding door also includes a sensing strip along one edge, such as a sensor for elevator doors, to release the door if an object is in the way. Hydraulic actuators are used for operation, as shown. The actuators can be moved very precise distances for the adjustments to ensure that only a minimum amount of material is removed from the bottom of the blade, and that a uniform grinding or sharpening job is accomplished across the entire length of the blade.

BRIEF DESCRIPTION OF THE DRAWINGS

FIG. 19 is a sectional view taken as on line 19—19 in FIG. 18;

DETAILED DESCRIPTION OF THE PREFERRED EMBODIMENTS

Figure 1:
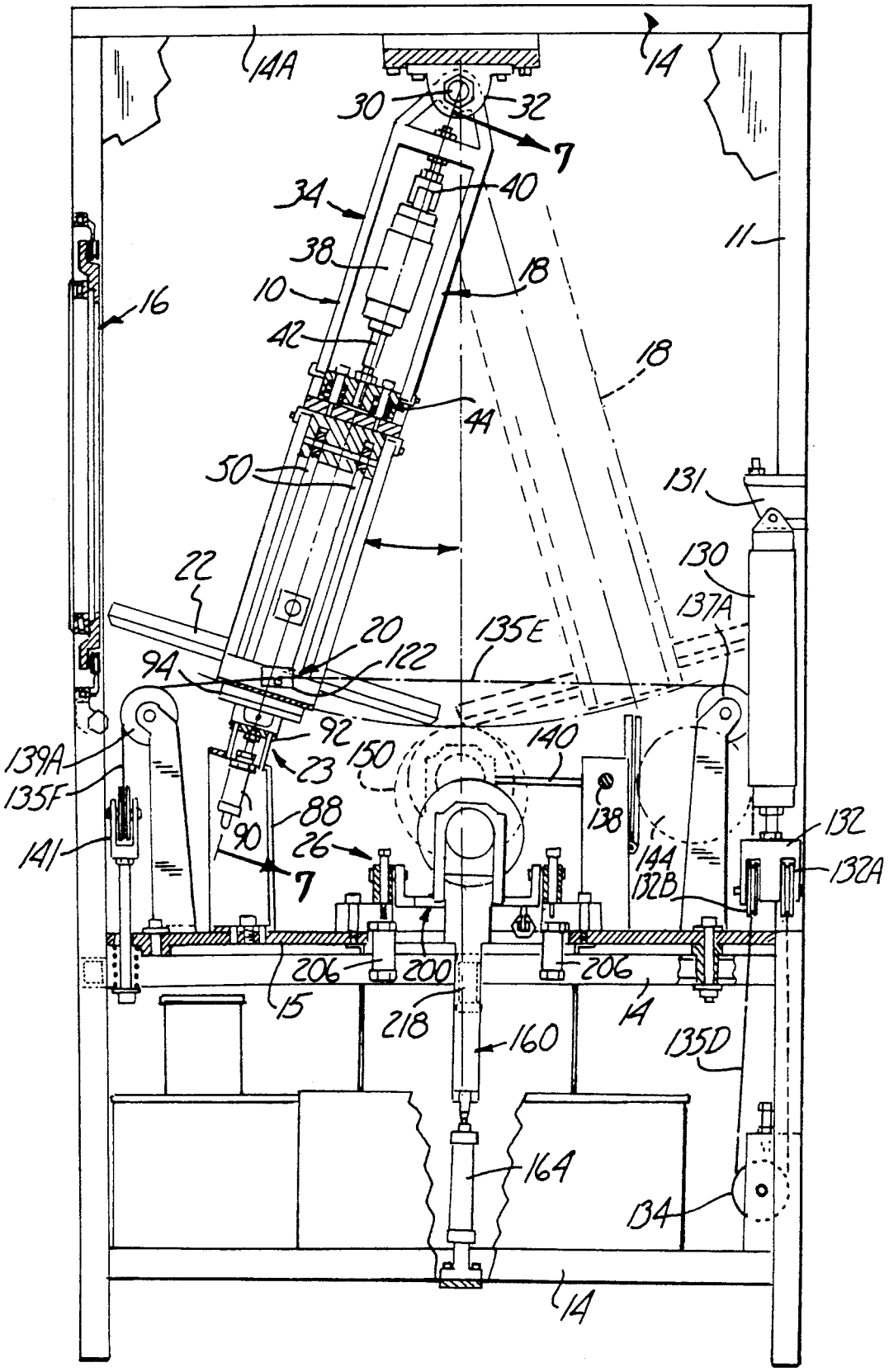
FIG. 1 is a side elevational view of a skate sharpening machine made according to the present invention with parts in section and parts broken away.

A skate sharpening machine shown generally at 10 comprises a frame 11 that has suitable vertical members and cross members for supporting the various components. A number of individual cross members will be shown individually, they do include a top members 14, and door support members 17 that will support an access door shown generally at 16 for access into the interior of the cabinet. The cabinet has suitable wall panels thereon so it is fully enclosed to enclose the various devices. The front panel has a narrow access opening that is covered by the sliding door when in a closed position and when the door is open an operator can place a skate in the unit. A main support plate 15 is supported by the frame and is used for supporting major components. It can be removed together with its mounted components as a unit.

As shown generally, there is a skate supporting swing arm assembly 18 that has an ice skate blade clamp 20 at its lower end. The arm also carries, as seen in FIG. 2, a retractable skate blade centering assembly 22 which is operable to engage the ends of an ice skate blade placed in the open (unclamped) blade mounting clamp to center a skate blade longitudinally when a skate is first placed in the assembly with the clamp in an open (unclamped) position.

A skate blade "bottom plate" or support pad assembly indicated at 23 is positioned against the bottom of the blade mounting clamp with the swing arm assembly 18 in its loading position, for supporting a skate blade when it is first put into the swing arm assembly. This support pad retracts after clamping, when the sequence of operations for grinding the skate blade edge is to start.

Figure 2:
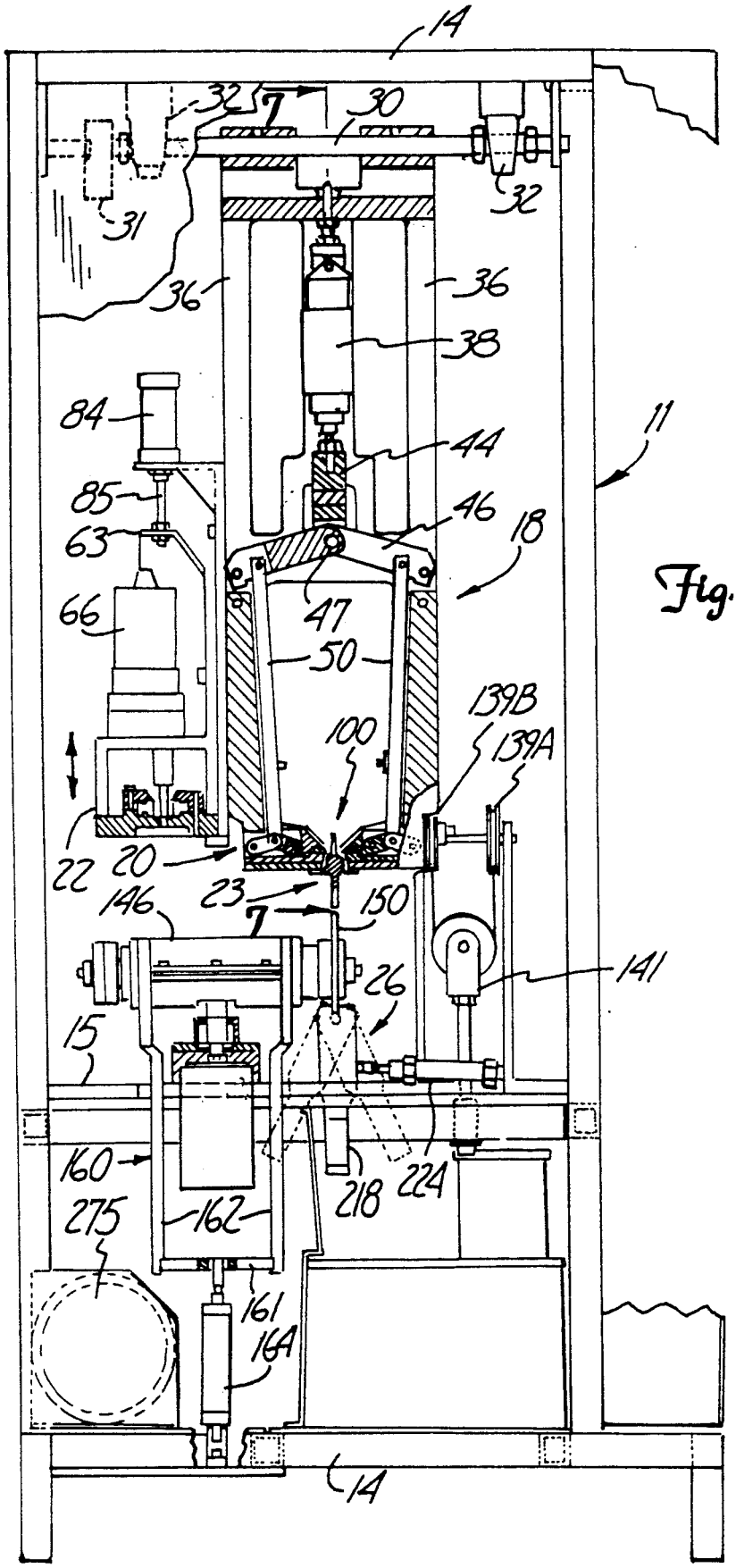
FIG. 2 is a front elevational view of the skate sharpening machine shown in FIG. 1 with parts in section and parts broken away.

Additionally, there is a grinding wheel assembly 24 that is indicated in FIG. 1 in phantom lines and in solid lines in FIG. 2. A grinding wheel dressing assembly 26 that will dress the edge of the grinding wheel edge prior to grinding operations is also shown.

The swing arm assembly 18 is pivotally mounted on a pivot shaft 30 that is supported on suitable bearing supports 32 to a top cross member 14. A shaft encoder 31 is driven by the shaft and provides pulses indicating the position of the shaft and the swing arm assembly relative to its home or reference position. These signals are used in a logic controller to time other operations. As can be seen, the swing arm assembly includes a frame 34 that has a pair of side frame sections 36, 36 that are spaced apart and which have suitable cross members therein for supporting various mechanisms needed. The swing arm frame is a case made for rigidity and can be cast or fabricated. The swing arm assembly 18 supports the skate blade clamp assembly 20.

A hydraulic actuator 38 for operating the blade clamp is supported through a suitable swivel connection 40 to a cross member on the swing arm frame 34. The hydraulic actuator 38 is a double-acting actuator having an extendable and retractable rod 42 which is coupled through a connector 44 to a first toggle linkage 46 that has a pair of double links, each of which is pivoted along one of the sides of the frame 34. Reference should be made to FIGS. 6–9 for details of the swing arm assembly construction. Pivots shown at 46A support ends of links 46 relative to the swing arm frame 34, and a center pivot pin 47 is used for connection of the two sets of links 46 together in a conventional manner. There are slots at the mating ends of links 46 where pivot pin 47 rides. Upon movement of the rod 42 of the actuator 38 the links 46 pivot about the pivots 46A and will create a force acting on two sets of longitudinal struts 50, 50 on opposite sides of the swing arm frame 34, that are suitably guided and connected to linkages to actuate the clamp, as will be explained. The struts 50, 50 are pivotally mounted as at 52, respectively, to respective links 46. The slotted pivot at pin 47 permits movement of the links 46 about pivots 46A.

The connector 44 between actuator rod 42 and links 46 is a spring-loaded connector having one block 44A connected to the rod 42 and a second block 44B which attaches to links 46 at pivot 47. The blocks 44A and 44B are retained together by shoulder bolts 44C which thread into block 44B and have heads 44D on the outside of 44A. Block 44A has a pair of spring pockets 44E which receive stiff compression springs 44F that exert a force holding the blocks 44A and 44B apart, except when clamping forces are very high. This accommodates different width skate blades, as will be evident.

Prior to the time that a skate blade is clamped in the blade clamp 20, the skates are moved so that the skate blade is centered in the clamp 20 in a longitudinal direction. A sensor, such as a laser sensor, or other suitable sensors, as shown comprising a source 54 and receiver 56 are positioned on opposite sides of the clamp assembly, and are supported in suitable blocks 58 that extend between the side members 36, 36 in the blade clamp area. A signal from the sensors 54 and 56 will be used for activating as many components as desired, including the skate centering assembly 22, which is shown in greater detail in FIGS. 3, 4 and 5. The skate centering assembly 22 is supported on the side of the swing arm frame 34 through a suitable support plate 58, which has edge slide-guides 61 for a frame 63. The frame is movable along the guides 61. The centering assembly comprises a rack and pinion arrangement 62 which includes a rack base member 64 having first and second track ribs or guides 64A and 64B that are spaced apart (see FIG. 5), and extend in the longitudinal direction of a skate blade that is positioned in the skate clamp of the swing arm assembly. The skate blade of a skate placed in the skate holder and skate clamp is supported on the pad member 22 with the swing arm frame 34 in its home or loading position as shown in FIG. 1. When a skate is placed in the swing arm assembly and clamp assembly 20 and the sensors 54 and 56 provide a signal, the skate centering assembly is lowered by lowering frame 63 until skate blade end arms 72A and 72B carried by the centering assembly are at a level with the ends of the supported skate blade shown at 74. The skate is placed in toe first. An actuator 84 operates to lower the frame 63 and the centering assembly from a retracted position. A motor 66 is then powered to drive a pinion gear 68 which is engaged with both of a pair of toothed racks 70A and 70B which are slidably mounted on the respective ribs 64A and 64B and supported on plate 64. The rack 70A carries the skate blade locating reference arm 72A with a bracket 71A which protrudes laterally from the rack and aligns so that it will intercept the front or toe of the skate blade 74. The arm 72A is fixed to the rack 70A and will engage the toe end of the blade as the rack 70A is driven in direction of arrow 73 and rack 70B is driven in the opposite direction.

Figure 4:
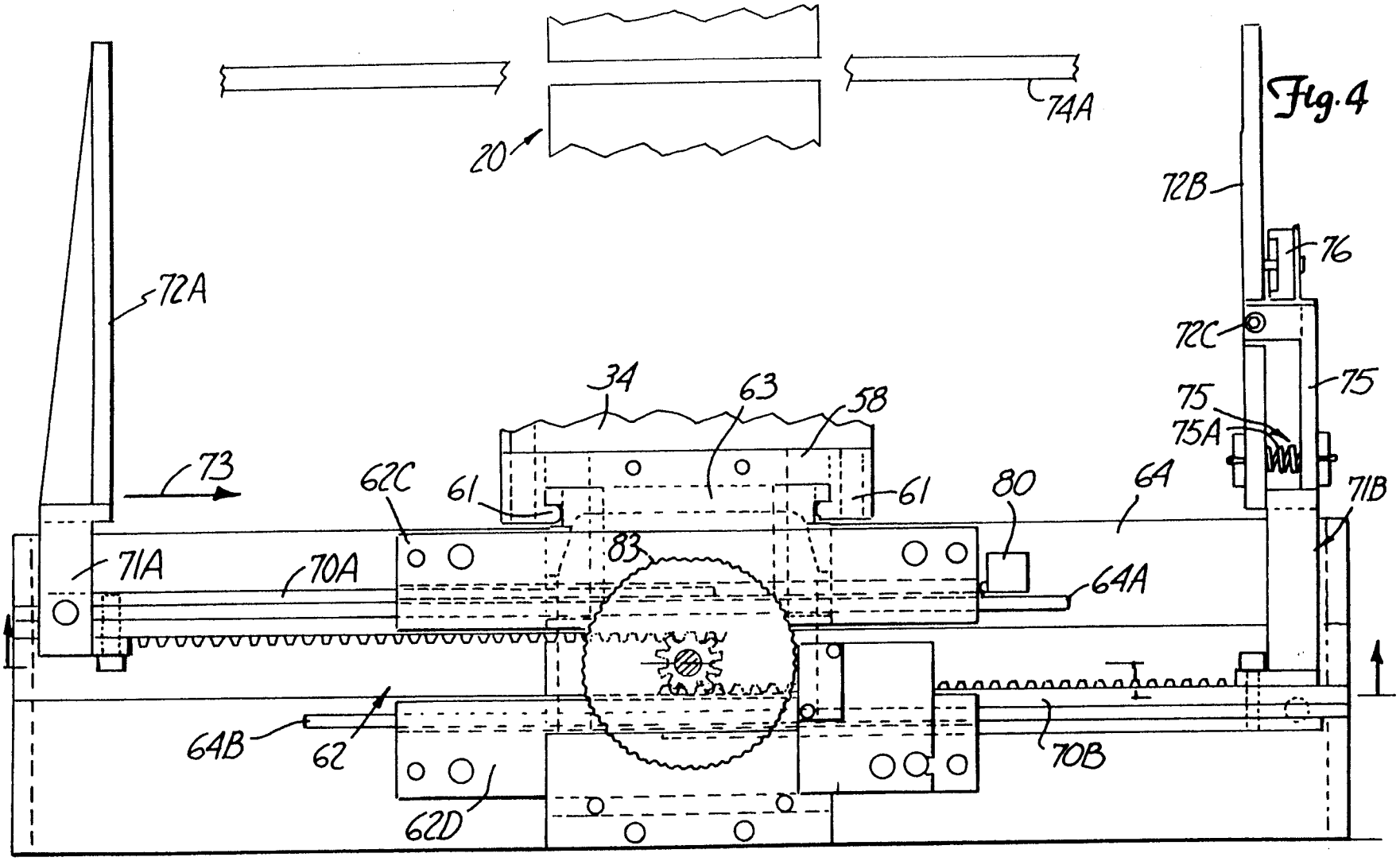
FIG. 4 is a top plan view of the device of FIG. 3.
Figure 5:
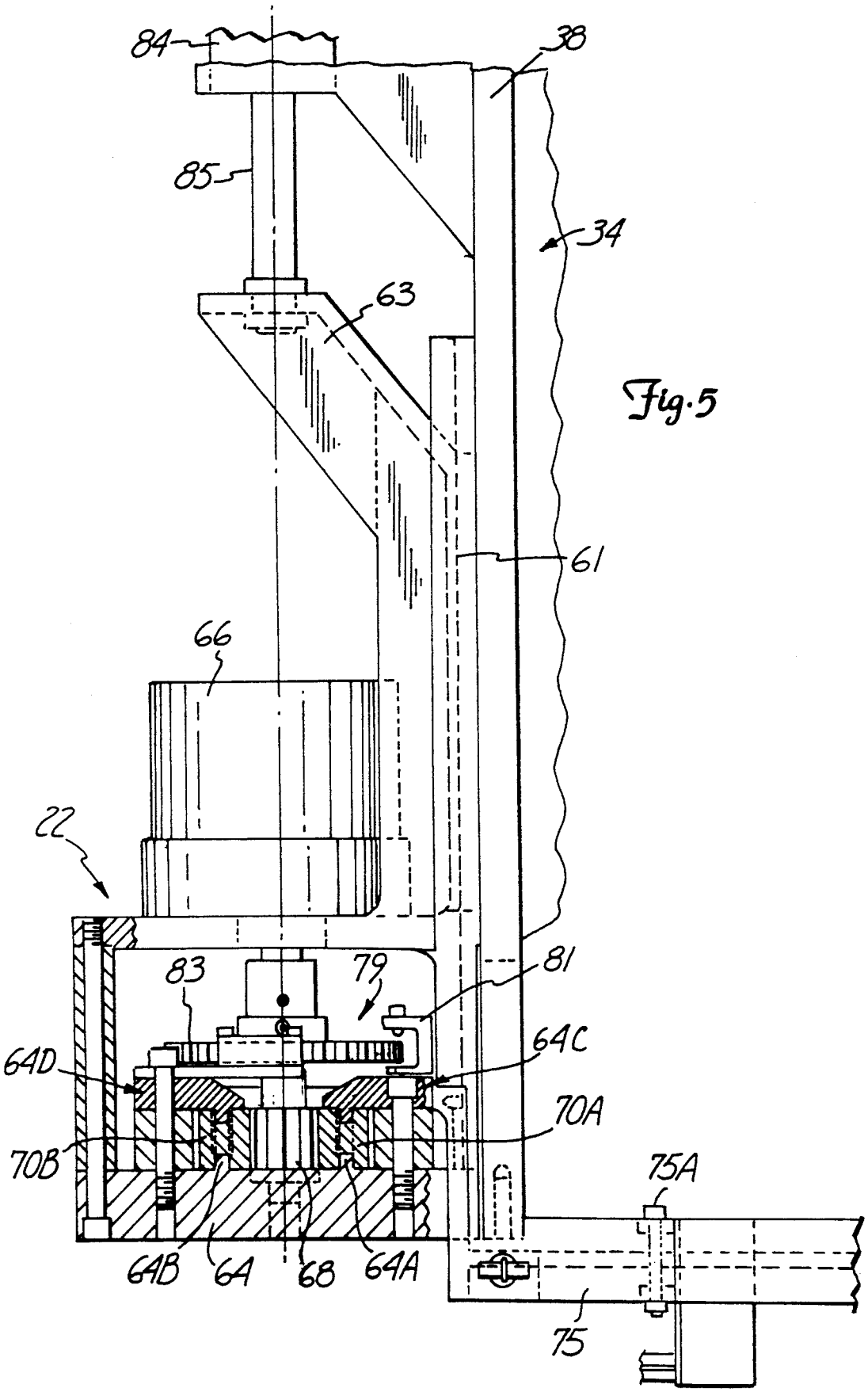
FIG. 5 is a sectional view taken as on line 5—5 in FIG. 3.
Figure 6:
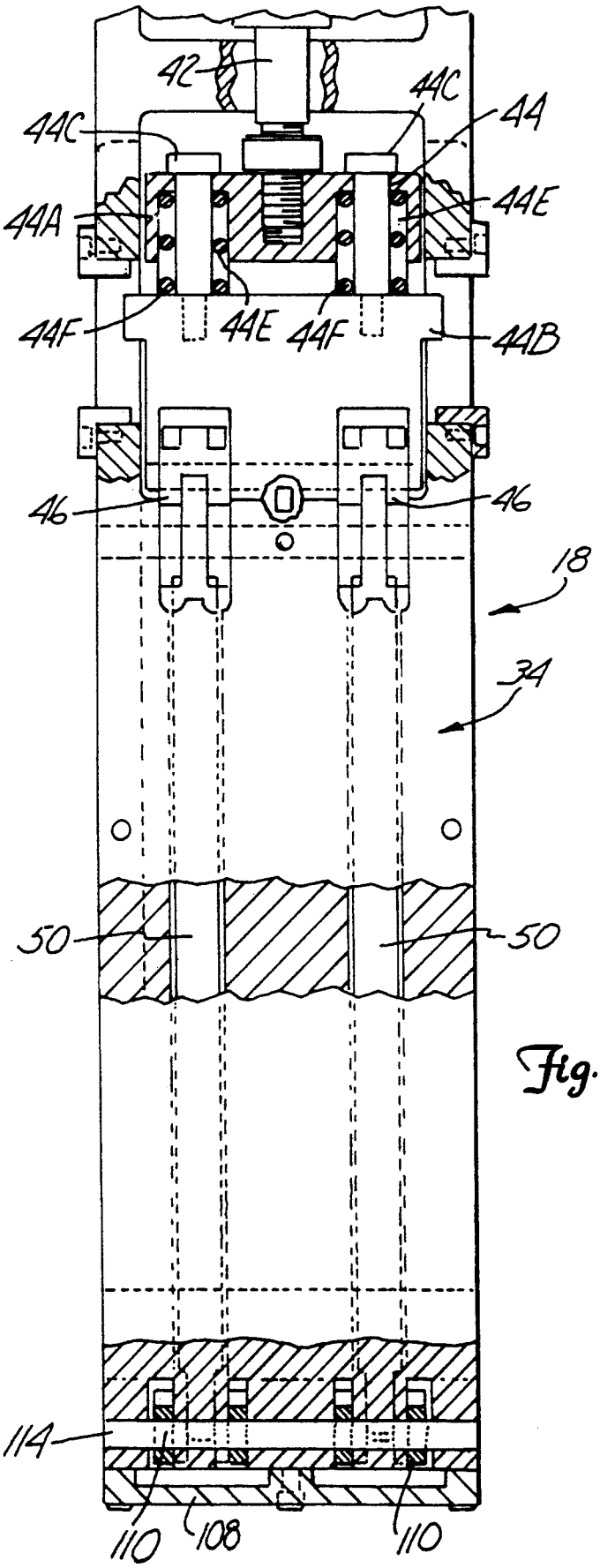
FIG. 6 is a side elevational view of a skate support swing arm assembly made according to the present invention.

The rack 70B carries arm 72B using a bracket 71B that senses the heel end of the blade of a skate plated in the blade clamp 20, which is shown schematically in FIG. 4. The arm 72B is pivotally mounted on a pivot pin 72C to a fixed arm section 75, fixed to rack 70B. A tension spring 75A holds the outer end of arm 72B under a spring load against a stop on bracket 71B. Arm 75 carries a magnetic microswitch 76 and when the arm 72B contacts the end of the skate blade as the motor and rack and pinion drives the arm 72A and 72B together, the rear end of the skate blade is stopped by arm 72A so the force on pivoting arm 72 increases sufficiently to cause the switch 72 to be activated. The force of the racks moving the arms 72A and 72B is sufficient to move the skate to a centered position, and when centered the skate blade is sandwiched between arms 72A and 72B so the microswitch 76 provides a signal.

Figure 3:
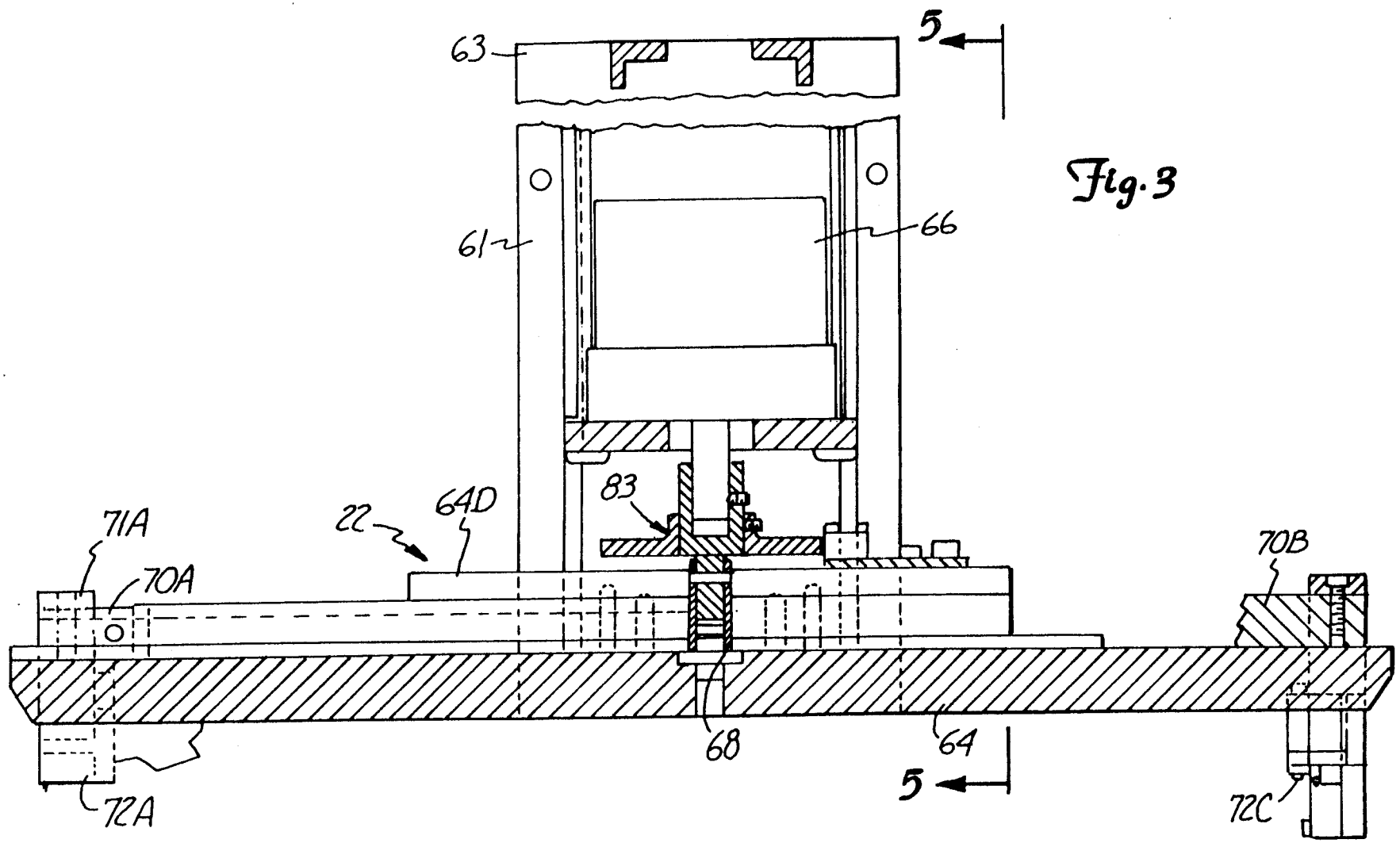
FIG. 3 is a side elevational detailed view of a skate centering assembly made according to the present invention.

The arms 72A and 72B are held on the ends of the respective rack with suitable brackets 71A and 71B as can be seen in FIG. 3.

An actuator 84 is mounted on a block 58 so that it is supported relative to the swing arm frame 34. Actuator 84 has a longitudinally extendable and retractable rod 85 that engages the sliding bracket 63. The edges of bracket 63 are slidably guided in guides 61 so that the rack assembly, which is supported on bracket 63 can be raised sufficiently to clear the skate blade, after centering, to permit the grinding operation to take place without interference from the skate centering assembly 22. The actuator 84 moves the skate centering assembly to its position where arms 72A and 72B will be aligned with the ends of a skate blade supported on the skate blade support pad assembly 22 before the start of each sharpening operation, and when the microswitch 76 indicates the skate has been centered, the blades will be retracted and operation of the actuator 84 will occur to retract or raise the skate centering assembly out of the way for further operation.

The bracket 63 is used for mounting motor 66 and rack and pinion assembly 64. The motor 66 is suitably coupled to drive the pinion gear 68, which in turn will drive the racks 70A and 70B simultaneously, but in opposite directions, so the arms 72A and 72B move either toward or away from each other.

The centering operation occurs by driving the racks until one of the arms 72A or 72B engages the skate blade end, and the arms will then continue to drive the skate blade longitudinally in the appropriate direction relative to the relaxed skate clamp assembly 22 (in an unclamped position) until such time that the second arm engages the opposite end and the forces are sufficient to operate the microswitch 76. A microswitch 80 can be mounted on the plate 64 to provide indication that the rack has reached the end of its centering travel without clamping or positioning the skate blade.

A shaft encoder 79 is provided on the motor shaft of motor 66. It comprises a toothed gear 83 and a laser sender-receiver sensor unit 81, which aligns with the teeth of the gear with the sender on top and receiver on the bottom to provide an electric pulse each time a tooth passes the sensor thus a count is provided for determining the position of the skate counter unit and to provide signals indication is a short skate blade is installed. If the arms 72A and 72B are under the sole of a skate boot the arms will be spread before the assembly is retracted.

Figure skate sharpening is an option when a manual or operator input indicates that a figure skate has been installed, the position of the rack, as indicated by encoder 79, will provide information to avoid grinding of the serrated toe end of the blade of the figure skate.

The racks 70A and 70B are held in place with hold-down guides 64C and 64D that hold the racks in appropriate position for sliding movement. The guides 64C and 64D are supported on spacers back to plate 64, which is mounted on the sliding bracket 61.

The skate blade support pad assembly 23 is mounted on a suitable frame plate 15 that is mounted on support plate 15. An actuator 90 is mounted on a bracket 89 which is mounted on frame member 88. The rod of actuator 90 supports a sliding connector 92 and a support pad 94 is pivotally mounted at 91 to connector 92 directly below the clamping elements of the clamp assembly 20. The pad 94 is "T" shaped with a rib 95 that fits into a recess or gap at the bottom of the clamping assembly. The flanges 93 of the pad 94 are forced tightly against a bottom location plate 108 so the top surface of rib 95 of the skate blade support pad is repeatably and precisely positioned relative to the clamp and the swing arm. The bottom edge of the skate blade is supported at the precise location needed for the sharpening operation.

The actuator 90 is operated to retract the pad 94 at the same time that the actuator 84 is operated to lift the skate blade centering device.

It also should be noted again that the arms 72A and 72B are retracted or spread prior to lifting the skate blade centering assembly so that it is assured that there will be clearance at the ends of the skate blade. This retraction would come at a defined time interval after the clamping assembly had been operated, or after a signal from a sensor on the clamp indicates the clamp is closed, as will be explained.

Also, it is subsequent to operation of the clamping assembly that the support pad 94 for the skate blade 74 would be retracted. The support or connector 92 for the skate blade pad 94 is suitably guided on guide rods in the bracket 89 for reciprocal movement.

Referring again to FIGS. 6, 7, 8 and 9, the skate clamping assembly is shown in greater detail. As previously mentioned, the actuator 38 controls a linkage that will in turn reciprocate struts 50, 50. There are a pair of struts 50 on each of the sides of the swing arm frame, one on each link 46, and the lower ends of the struts 50 are pivotally mounted on clamping toggle links that operate slidable clamp jaws.

Figure 7:
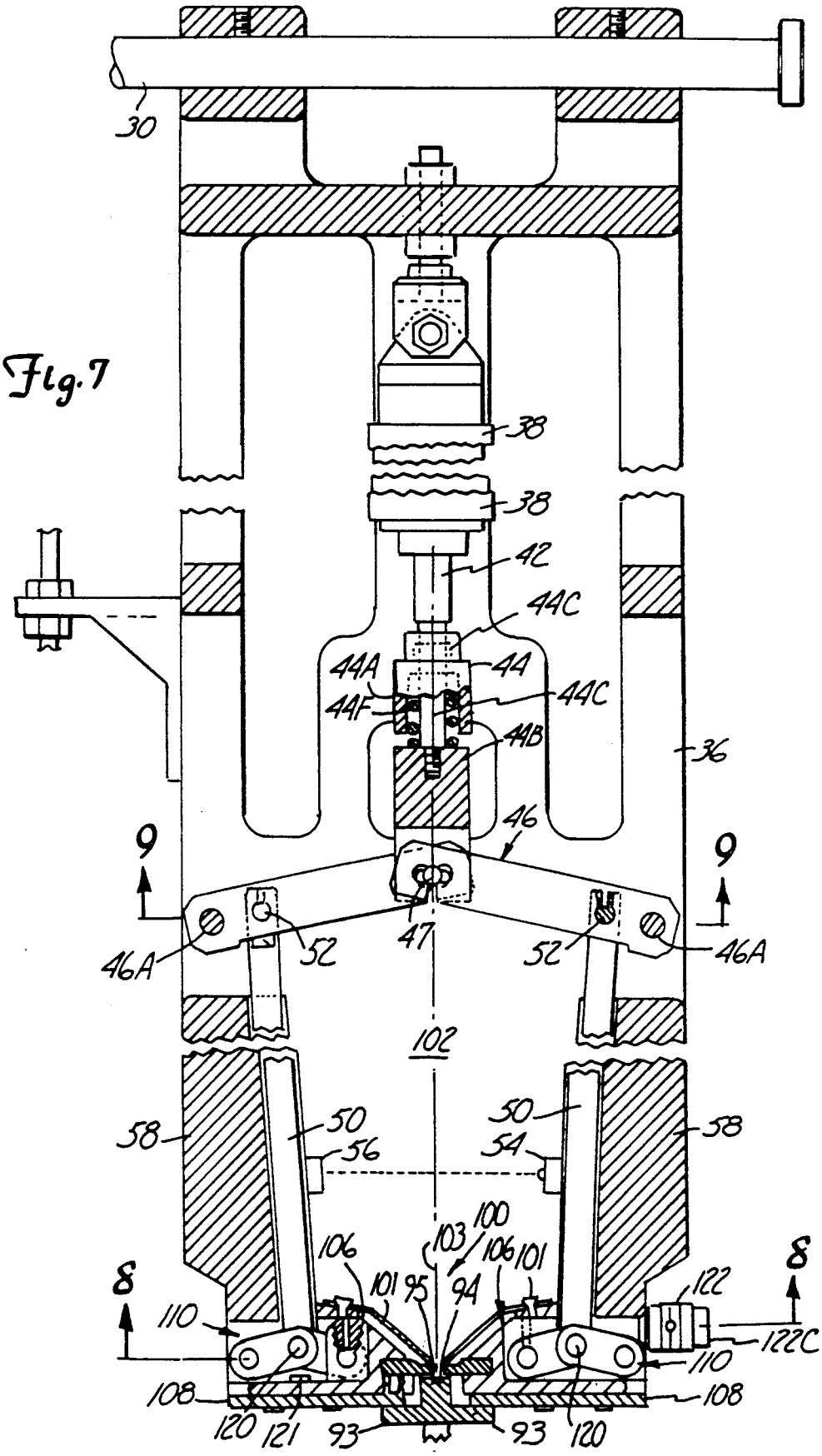
FIG. 7 is a sectional view taken as on line 7—7 in FIG. 2.
Figure 8:
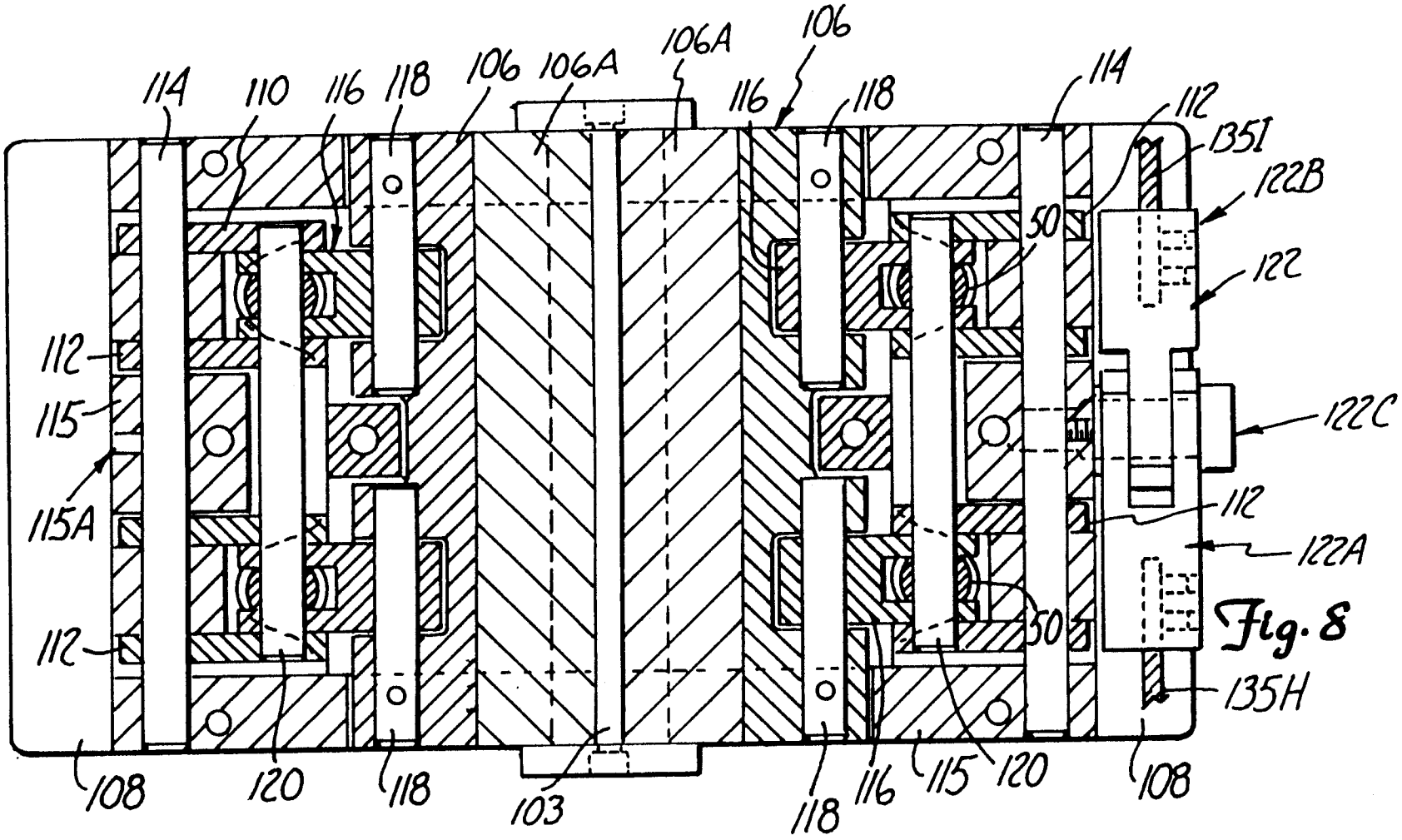
FIG. 8 is a sectional view taken as on line 8—8 in FIG. 7.

As can be seen in FIG. 7, a suitable guide chute 100 is provided on the skate receiving area 102 between the frame blocks 58, 58. The guide chute 100 has tapered guide members 101 on each side of the centerline 103 for the skate blade so that the skate blade will slide down into position in the gap between spaced apart sliding clamp jaws 106, 106 and come to rest with the bottom edge or surface of the skate blade supported on the support pad rib 94, and with the sides of the blade between sliding clamp jaws 106, 106.

The sliding clamp jaws 106 are supported on suitable support plates 108, 108 on opposite sides of the centerline 103 for movement toward and away from the clamp jaws. The plates 108 are the locating plates contracted by flanges 93 of the skate blade support pad as well.

Figure 9:
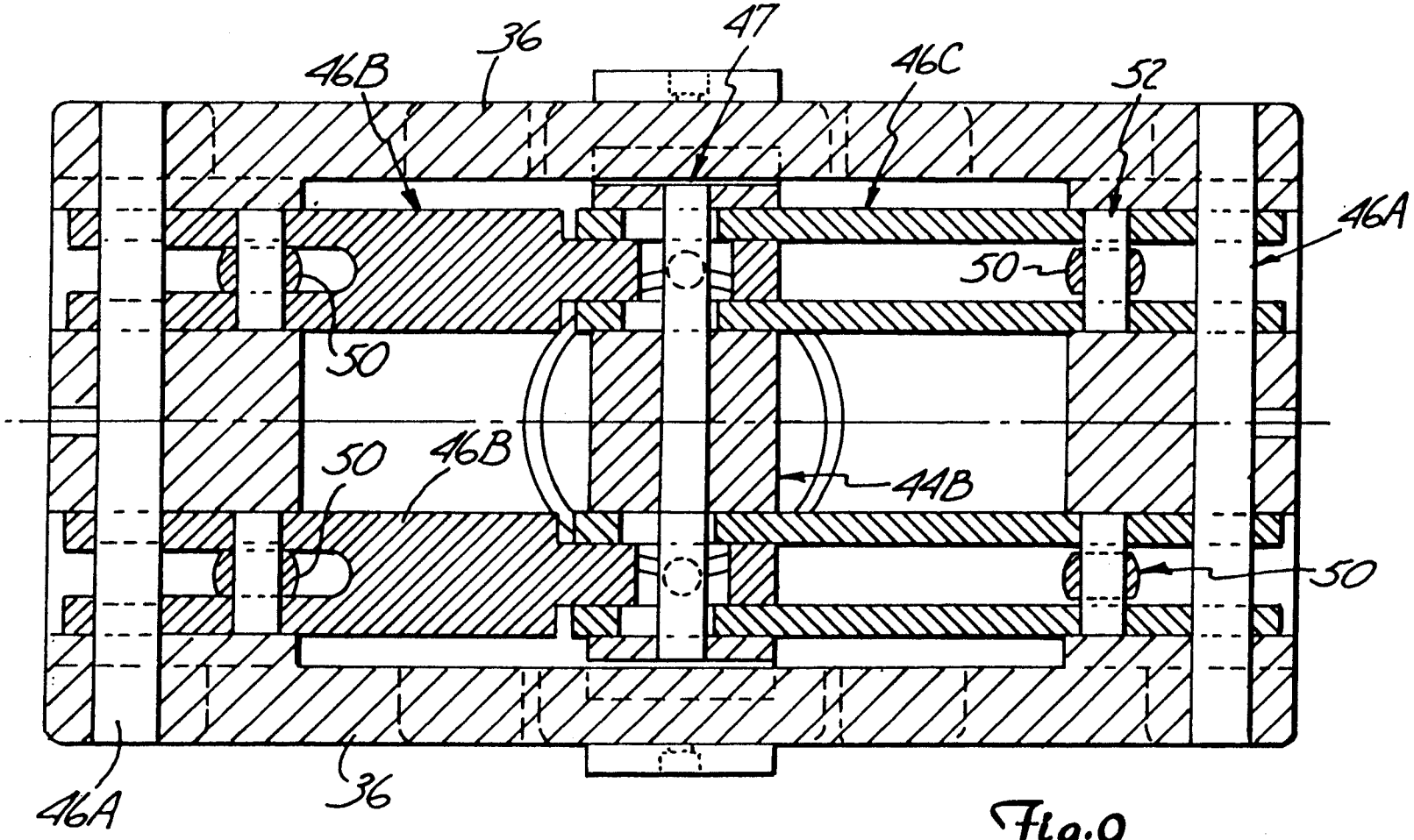
FIG. 9 is a sectional view taken as on line 9—9 in FIG. 7.
Figure 10:
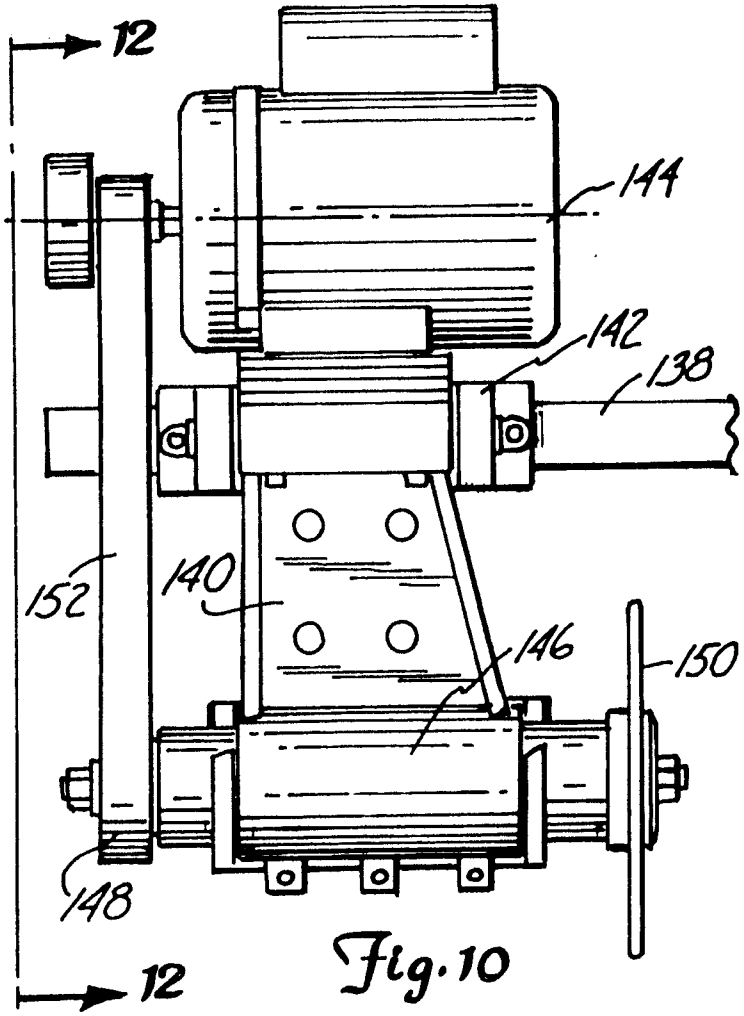
FIG. 10 is a top plan view of a grinding wheel and motor drive assembly of the present invention.

As shown in FIG. 9, the links 46 include a pair of solid links 46B, 46B pivoted on one side of the frame 34 and a pair of links 46C pivoted on the other side of the frame. Each link 46 is made up of two spaced straps so that the aligning links 46B and 46C can pivot together in the center at pivot 47. The links 46B and 46C each support suitable rod end connectors for a strut 50. The pins used for pivots 46A are shown in greater detail in FIG. 10. It can be seen that the connector 44B for the actuator has a center block for connecting to the clamp linkage assembly.

At the lower end of the swing arm assembly, the clamp jaws 106, 106 are supported for clamping movement. The clamping toggle linkages are shown in greater detail in FIG. 8. The clamp jaws 106, 106 are supported on the bottom plates 108, 108 on opposite sides of the centerline 103 of the skate blade. The jaws 106, 106 carry hardened clamp jaw plates 106A, 106A with narrow jaw faces on opposite sides of the centerline 103 of the skate blade.

Toggle linkages indicated at 110, 110 are used for moving the sliding clamp jaws 106 and the jaw plates 106A between clamping and release positions. The toggle linkages 110 on each side of the centerline comprise a pair of links that are spaced in direction of the longitudinal axis of the blades to provide adequate force along the length of the clamp jaw that is used. Each of the links 110 has a first anchor link 112, which is formed of two straps and which is mounted onto a suitable pivot pin 114 that in turn is supported on base 115 that are attached to the frame blocks 58 of the swing arm frame 34. The pins 114 form pivot pins for the link sections 112.

The base 115 is recessed in desired regions to provide suitable clearance for the links while holding the pivot pins and other mechanisms. The pins 114 are held from rotating on the base by set screw 115A. The link sections 112 are connected to second link sections 116 that in turn are each individually pivotally mounted with suitable pins 118 onto the sliding clamp jaws 106, 106. In other words, the pins 118 are mounted onto clamp jaws 106 so that movement of the toggle linkages will cause the clamp jaws 106 to move toward or away from the centerline or axis 103 of the skate blade.

The link sections 112 and 116 for each of the jaws are joined with a common pivot pin 120 on each side of the jaw, and the pivot pins 120 in turn are mounted in end connector of the struts 50 on each side of the frame. The struts 50 have suitable rod ends or spherical seat connectors to carry the loads exerted by the links 46 and the actuator 38.

Very high clamping forces can be generated with the near center toggle linkages, so that the skate blade is positively held between the hardened jaws 106A, 106A. The spring load at block 44 is very stiff, but does permit clamping blades of different thickness without mechanical adjustment.

A cable connector assembly 122 is provided at one side of the swing arm frame to provide the power for moving the swing arm during grinding.

Once the skate is clamped in position, through the operation of the skate centering assembly and skate support and the clamp mechanism just described, the swing arm is moved about the pivot shaft 30 through the operation of an actuator 130 that is supported on a bracket 131 to the frame, and which has an extendable and retractable rod that carries a pulley assembly 132 to operate a cable 133 through suitable guide pulleys 134, the cable is fastened to retainer bracket 122 on the swing arm assembly frame 34. The pulley assemblies 134 are positioned to provide a substantially linear movement of the cable back and forth during operation of the actuator 130 to cause the swing arm to pivot and to move a skate blade across a grinding wheel assembly, which has been suitably dressed to the proper surface configuration. The cabling will be more fully described in connection with a schematic illustration of the cables and pulleys.

The grinding wheel assembly 24 is best illustrated in FIGS. 10–13, and has a frame 140 mounted onto a shaft 138, which in turn is mounted in suitable bearings in brackets 142. The brackets 142 are attached to the frame plate 15 or to frame members as desired.

The axis of the shaft 138 is parallel to the axis of the swing arm assembly mounting shaft 30. The grinding wheel assembly is constructed like a teeter-totter, and on one side of the shaft 138, the main frame 140 mounts a motor 144 that acts as a counterweight for the grinding wheel hub 146, which is on the other side of shaft 138 from the motor. The grinding wheel hub or housing 146 mounts a shaft on suitable bearings in a normal manner, and has a drive pulley 148 on one end, and the grinding wheel 150 is mounted on an opposite end of the shaft. The motor 144 also has a drive pulley thereon which drives a belt 152 to rotate the grinding wheel when the motor 144 is powered.

Figure 13:
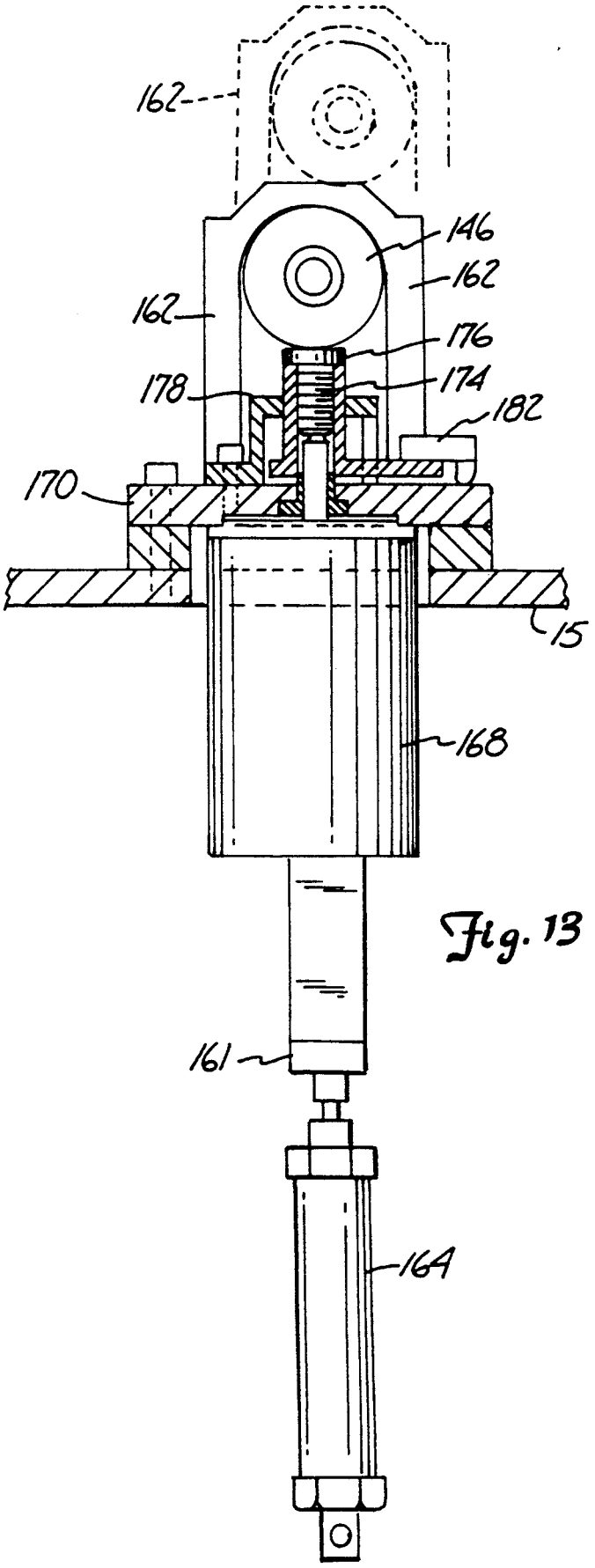
FIG. 13 is an enlarged side view of a dressing stop positioner for the grinding wheel shown in FIG. 12.

Suitable counterweights indicated at 156 are attached to the motor, to tend to urge the grinding wheel 150 upwardly about the axis of shaft 138. Upward movement of the grinding wheel is controlled by a yoke assembly 160 which has a pair of U-shaped yoke members 162, 162 that fit over the ends of the hub or housing 146 for the grinding wheel assembly. A lower cross member 161 is attached to the legs of the "U" in a suitable manner and is also attached to a rod of an actuator 164 that can be controlled as to its position to pull the grinding wheel assembly down about the axis of the shaft 138 into a position where the grinding wheel will be dressed or shaped prior to grinding. The lower end of the actuator 167 is suitably mounted to the machine frame. When the actuator 164 is operated in the second direction, the yoke assembly 160, as can be seen in FIG. 13, will move upwardly sufficiently to provide for a clearance gap shown in FIG. 13 at the top of the hub 146 to permit the grinding wheel to move up against a bottom edge of a skate blade under the counterweight force, which can be controlled and is not prone to chattering, such as with a spring load. The counterweight caused force on the grinding wheel can be adjusted, of course, to accomplish the desired grinding-sharpening operation.

The downward movement of the yoke assembly 160, as controlled by the actuator 164, is used to position the grinding wheel 150 and the hub 146 against a positive stop that positions the grinding wheel edge surface relative to wheel dressing assembly 26 for dressing the grinding wheel.

Figure 11:
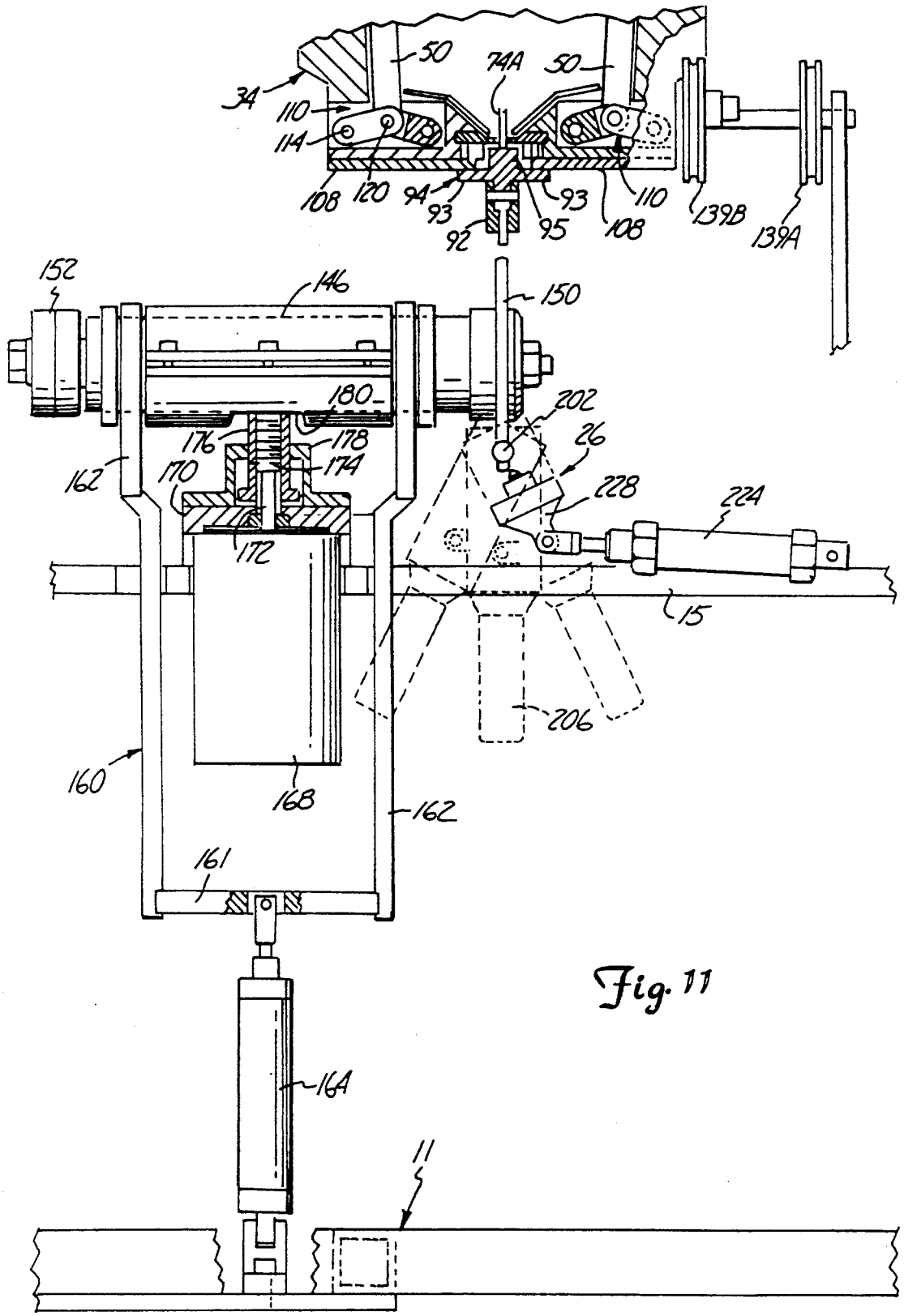
FIG. 11 is a front elevational view of the grinding wheel assembly.

The positive stop in the present form comprises a stepper motor 168 that is suitably attached to a mounting bracket 170 which in turn is mounted onto the mounting plate 15. The stepper motor 168 protrudes through an opening in plate 15, and has an output shaft 172 that is drivably connected to an externally threaded stud 174 which in turn is threadably mounted in a threaded bore of a positive adjustment stop 176. The stop 176 can be moved up and down relative to a housing bracket 178 that is fixed on the support 170, and each time the stepper motor is advanced a step in one rotational direction, which is 20 degrees of rotation in the present form, the positive stop 176 will be lowered by 0.003 of an inch, (because of the thread lead on stud 174 and stop 176) and this means that when the actuator 164 is retracted, the yoke member 160 will pull the outer periphery of the grinding wheel 150 lower by 0.003 inches. As can be seen in FIG. 11, the positive stop 176 has an end surface that abuts on a surface of a provided recess 180 on a lower side of the housing or hub 146. When positively stopped, the grinding wheel can be dressed.

The actuator 164 will have its rod extended during the skate blade sharpening operation, but prior to sharpening the grinding wheel may be held down to pull the wheel away from the skate blade at desired times. When the actuator 164 is retracted the yoke will pull the wheel downwardly against the positive stop.

A sensor shown in FIG. 13 at 182 is mounted onto a tab that protrudes out of the housing 178 and which is part of the positive stop 176. When the positive stop 176 is retracted its full amount, the sensor 182 will indicate that the amount of material removed from the grinding wheel during the dressing operations has reached the maximum. The signal from sensor 182 can be used for reversing the stepper motor up to its initial starting position with the stop 176 fully extended, and to provide a signal that can light a light or deactivate the controls to indicate that the grinding wheel needs to be replaced.

The dressing of the grinding wheel 150 prior to each sharpening operation is accomplished with the assembly 26, which can be adjusted so that it will grind the surface of the wheel either to provide a flat surface on the edge of the skate blade, or to provide a crown on the wheel that will form a hollow ground blade, which is a slightly concave blade surface on the lower edge of the skate blade being sharpened.

As shown in FIGS. 11, 14, 15, 16 and 17, the wheel dressing assembly 26 comprises a pivoting yoke member 200 which has mounting pins 202 on opposite sides thereof, which attach to upright, vertically movable support blocks 204. The support blocks 204 in turn are mounted to the rods of actuators 206, 206 on opposite sides of the yoke, which have their rods extending through spacer blocks 208, which in turn are attached to the support plate 15. The support plate 15 has an opening to provide clearance for the wheel dressing assembly. The movable support blocks 204 are suitably guided for limited vertical movement with studs 210 that thread into the spacer blocks 208 and slide in boxes in the support blocks 204. The actuators 206 can move the support blocks 204 and thus the pins 202 to two different positions.

Figure 12:
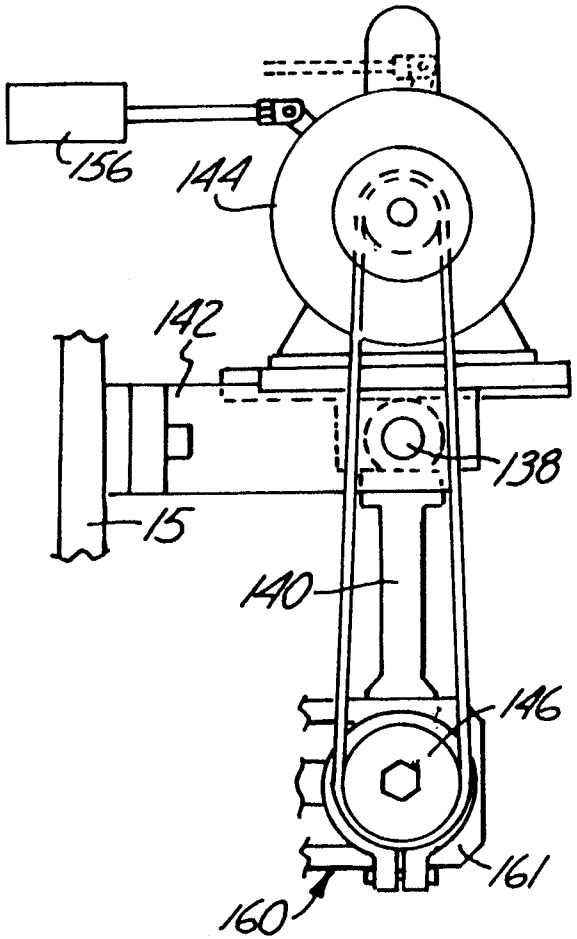
FIG. 12 is a side view taken as on line 12—12 in FIG. 10 which provides a side view from an opposite side from that shown in FIG. 1.

The yoke 200 includes swing arms 212, 212 on opposite ends thereof, and a cross member 214. The swing arms 212 are mounted on the pins 202 for pivotal movement, and the cross member 214 is fixed to the swing arms. The center portion of the cross member has a bracket 216 for supporting an actuator 218 on the bottom side. The actuator has a rod that extends upwardly and connects to a diamond point wheel dressing pin 220 that is slidably guided in a suitable bushing or other support in the cross member 214 and extends through the cross member 214. The end point of the dressing pin or dressing point, as can be seen in FIG. 12, is adjacent to the outer edge of grinding wheel 150, and is positioned to engage the edge of the grinding wheel when the grinding wheel is positioned against its positive stop in downward direction.

The yoke 200 is swung through an arc about the axis of the pivot pins 202 by the use of a horizontal actuator 224 that has its base end suitably connected to the support plate 15, and has its rod end connected to a control arm 228 fixed to the cross member 214.

Figure 14:
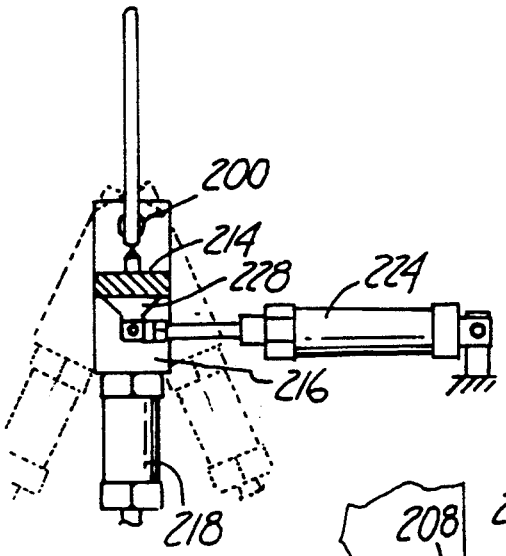
FIG. 14 is a detailed front view of a dressing apparatus for dressing the grinding wheels.
Figure 16:
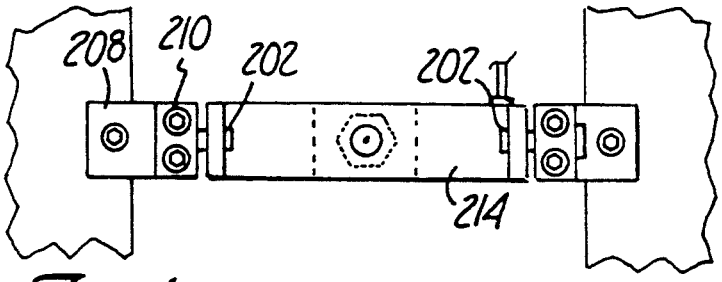
FIG. 16 is a top plan view of the device of FIG. 14.

Operating the actuator 224 will cause the yoke to swing about its axis as shown in dotted lines in FIG. 11 as well as in FIG. 14.

Figure 15:
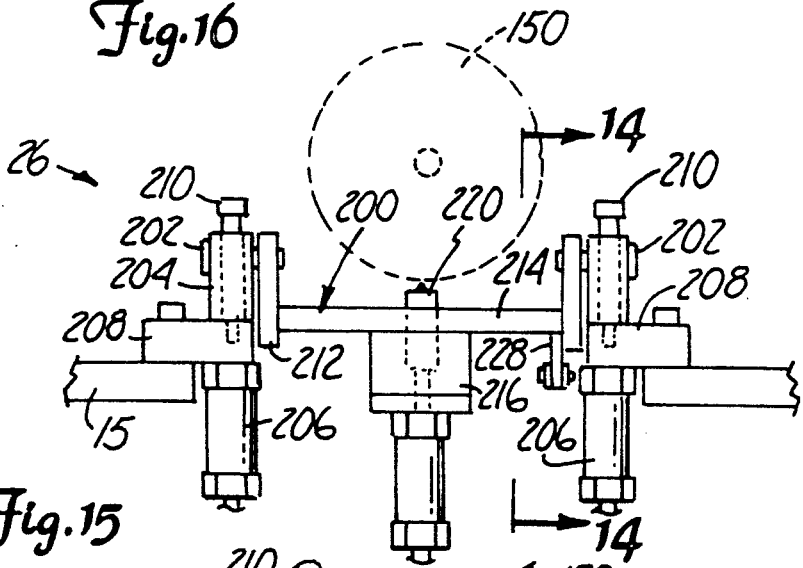
FIG. 15 is a side view of the device of FIG. 14 with the wheel dressing member in a first position.
Figure 17:
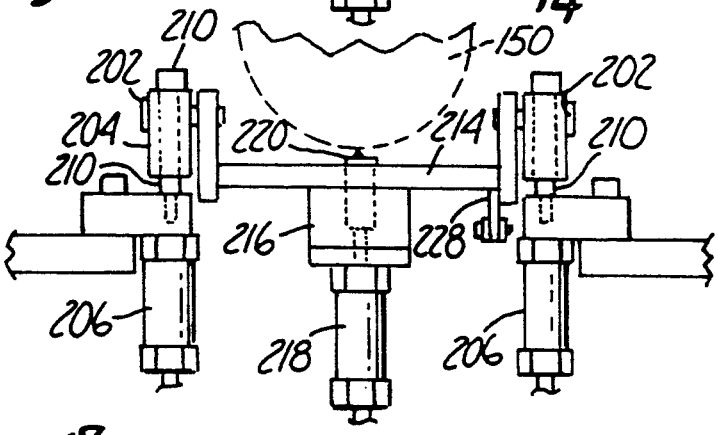
FIG. 17 is a side view of the wheel dressing apparatus with the dressing point in position for obtaining a different wheel profile from that of FIG. 15.

The radius of swing of the dressing point 220 can be changed from approximately 0.500 inches with the yoke 200 in its lowered or first position as shown in FIG. 15 to a radius of 0.900 inches as shown in FIG. 17 in a raised position. When the dressing pin 220 sweeps across the edge of the grinding disc indicated in phantom lines in FIGS. 15 and 17 it will dress the edge of the wheel into the desired configuration and in turn this will be the cross sectional configuration of the bottom edge of the skate blade.

At a 0.50 radius position, as shown in FIG. 15, the blocks 204 are seated tightly against the spacer block 208, and the wheel dressing pin 220 is extended by operating the actuator 218 to extend its rod and put the wheel dressing pin in a position so that it will engage the edge of the grinding wheel when the grinding wheel is down against its positive stop and has not been dressed.

This will give a very small radius to the edge of the wheel and will cause a hollow grind on the skate blade bottom edge, when such grind is selected by an operator.

If a flat edge is selected, then the actuators 206 will extend to move the blocks 204 and thus the axis of pivot of the yoke 200 upwardly and the wheel dressing pin will be retracted by its actuator 218, so that it is at the same vertical position relative to the edge of the grinding wheel 150, but it will be moving on a larger radius.

The retracting of the wheel dressing pin with blocks 204 raised again returns the point that is used for dressing to its same location relative to the periphery of the grinding disc as the position of the pin shown on FIG. 15.

In other words, the wheel dressing pin will remove 0.003 inches from the periphery of the grinding wheel after the adjustment of the positive stop, and the dressing operation will take place after a skate has been properly positioned, and clamped, but prior to movement of the wheel dressing swing arm. After the grinding wheel 150 has been dressed, then the swing arm will be actuated to pass across the wheel and cause the grinding of the bottom of the skate blade.

The access opening and sliding door to the enclosed cabinet is made to be relatively narrow, and of size so that after sliding it open it will receive the skate, but not unduly large to permit easy reaching in and tampering with any of the components.

Figure 18:
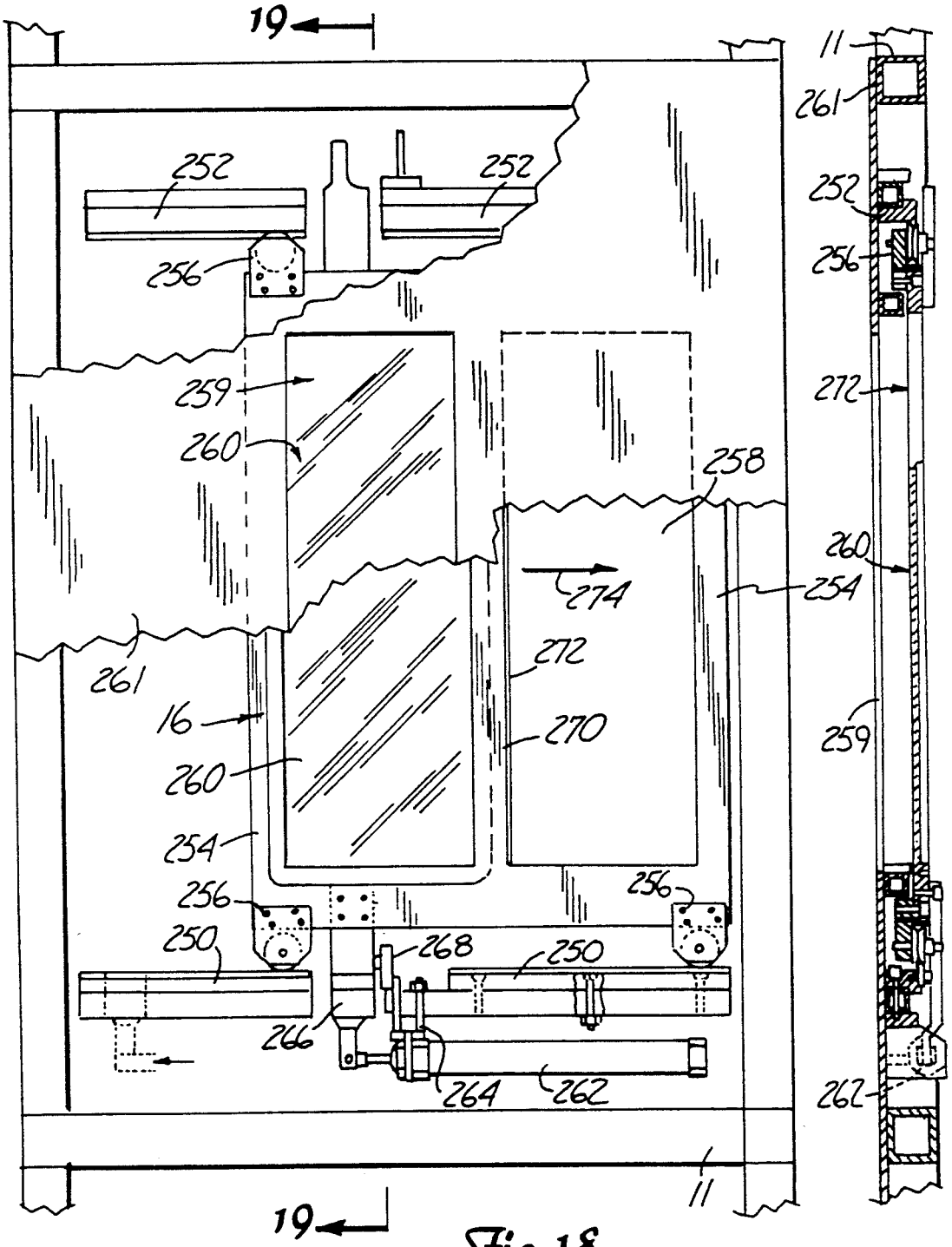
FIG. 18 is a front view of a cabinet sliding door assembly.

FIG. 18 is a front view of the sliding door, with the front panel of the cabinet removed. This is a schematic representation. The door assembly 16 is supported on suitable tracks 250, 250 at the lower side, and guide tracks 252, 252 at the upper side. These guide tracks are attached to a door frame 254 in any suitable manner. The door frame 254 has supports 256 at the corners for track guide rollers 258 thereon, at the corners. The door frame has two openings, one of which is an unobstructed opening indicated generally at 258, which is the access opening when the door is slid into registry with an opening in the front panel. This opening 258 is shown in position with the door closed, and the closing of the door covers the opening 259 in the outer cabinet panel 261 with a plexiglass or transparent panel 260.

The door is moved back and forth along the tracks by an actuator 262 that is supported on the main frame of the suitable bracket 264. The actuator 262 has a rod that connects to an arm 266 which in turn is connected to the door frame 254.

The closed position of the door 16 can be sensed by suitable sensors such as that shown at 268. This provides a signal when the door is in its closed position, to permit energizing the rest of the sequence for skate sharpening. The door actuator 262 will close the door after a preselected time from the time that a skate is sensed as being present in the skate clamp assembly by the skate sensor 54–56.

The edge 270 of the opening 258 which is provided with a strip-type sensor along its vertical length. This is a pressure sensitive pad 272. This is a type of a sensor that is used on passenger elevator doors, and in and of itself the sensor is well-known in the art. This sensor, when detecting the presence of an object between it and the edge opening in the cabinet panel that tends to resist passage of the door to its closed position, as indicated by the arrow 274, will provide a signal that will be sensed by a suitable controller that overrides the closing signal and causes actuator 262 to reverse direction and open the door. Again, a time delay can be used so that after a preselected time from a signal from the sensor strip 272 the door would again be closed by activating actuator 262 to allow time to remove a person's hand or any other object that might be jamming the door.

The plexiglass panel 260 permits a viewer to watch the sharpening operation but yet shields the viewer and prevents interference from the viewer during sharpening.

The movement of the swing arm is controlled, as mentioned by a cable 135 and pulley assembly operated by actuator 130.

Figure 20:
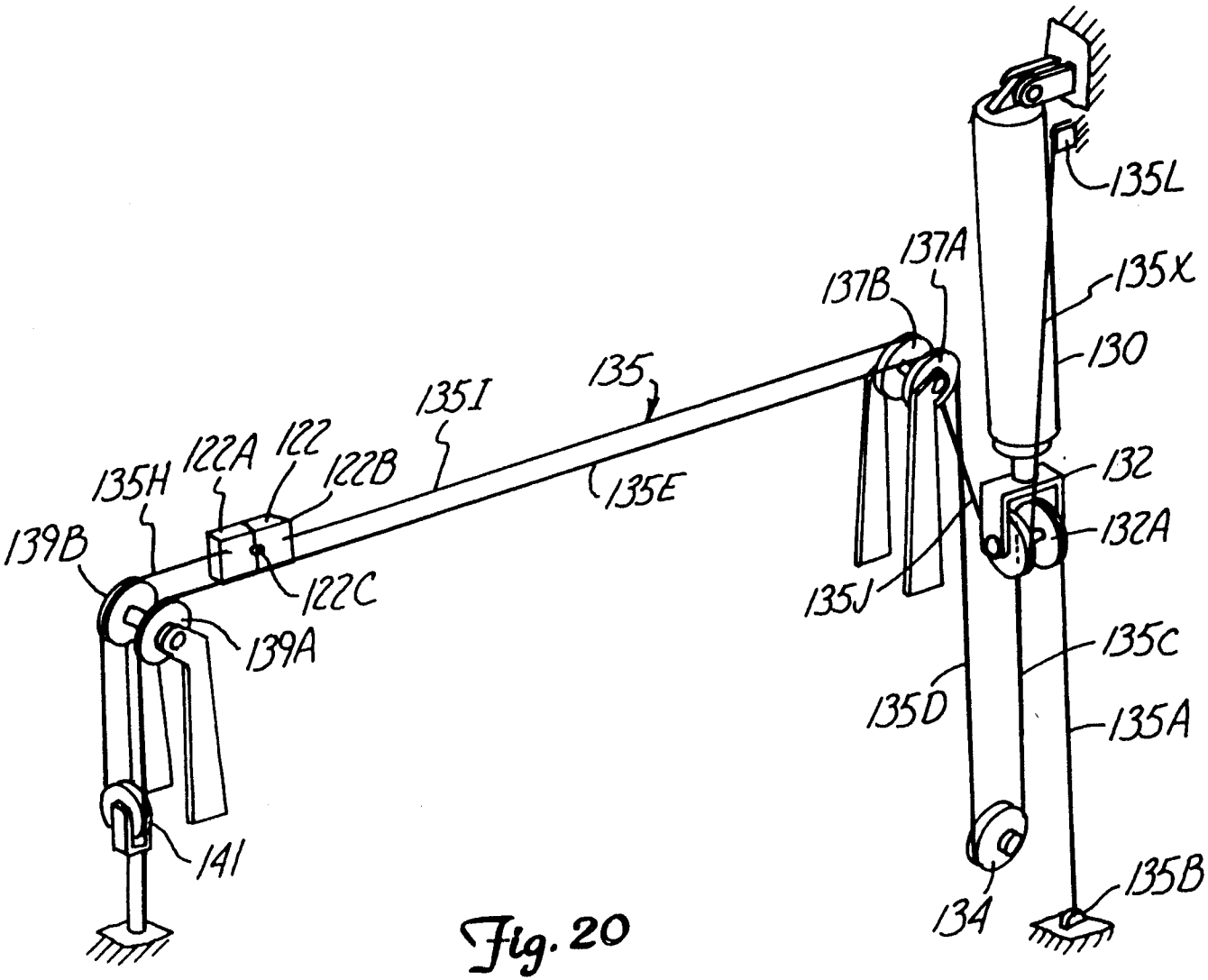
FIG. 20 is a schematic representation of a cable drive used for the skate sharpening machine.

FIG. 20 is a schematic representation of the cable reeving for illustrative purposes only, and is not intended to show exact alignment of the pulleys.

As shown, the swing arm assembly 18 has a bracket 122 thereon. Ends of cable 135 are attached to opposite ends of the bracket 122. The bracket 122 has sections 122A and 122B that are pivotally connected together by a pivot pin 122C to provide for better alignment of the cable as the swing arm assembly 18 moves through its radius of movement.

The pulley block 132 on the rod of the actuator 130 has a first pulley 132A, Which is mounted onto a common axis with a pulley 132B. A cable length 135A is dead ended as at 135B to the fixed bracket carrying a pulley 134. The cable length 135A then passes over the pulley 132A and extends back down with a cable length 135C to pass over the pulley 134. A cable length 135D then extends from the pulley 134 upwardly to a pulley 137A, which has an axis that is parallel to the axis of the swing arm assembly 18. The axis of pulley 137A is thus at right angles to the axis of pulleys 132A and 132B.

A cable length 135E then extends over to a pulley 139A, which is mounted on the frame plate 15 and has an axis parallel to the axis of the pulley 137A. Length 135E is a horizontal length of the cable. The cable then extends downwardly in a length 135F to pass around a pulley assembly 141 that is spring loaded, to provide a tension on the cable 135 in a suitable manner. The pulley 141 rotates about an axis that is perpendicular to the axis of the pulley 139A. The cable then extends up in a length 135G to pass over a pulley 139B, which is on the same axis as the pulley 139A. Then, a cable length 135H extends to the bracket 122A and is fastened or dead ended in that bracket.

The bracket 122B supports one end of a cable length 135I and the cable length 135I passes over a pulley 137B that is on the same axis of rotation as the pulley 137A. The cable then extends back downwardly toward the actuator bracket 132 and a cable length 135J passes over the pulley 132B which is supported in bracket 132. After passing over the pulley 132A the cable extends back upward in a cable length 135K and is dead ended as at 135L to the main frame. This provides a continuous cable that controls operation of the swing arm in both directions of movement of the actuator 130, so that the back-and-forth movement of the swing arm is precisely controlled.

Figure 21:
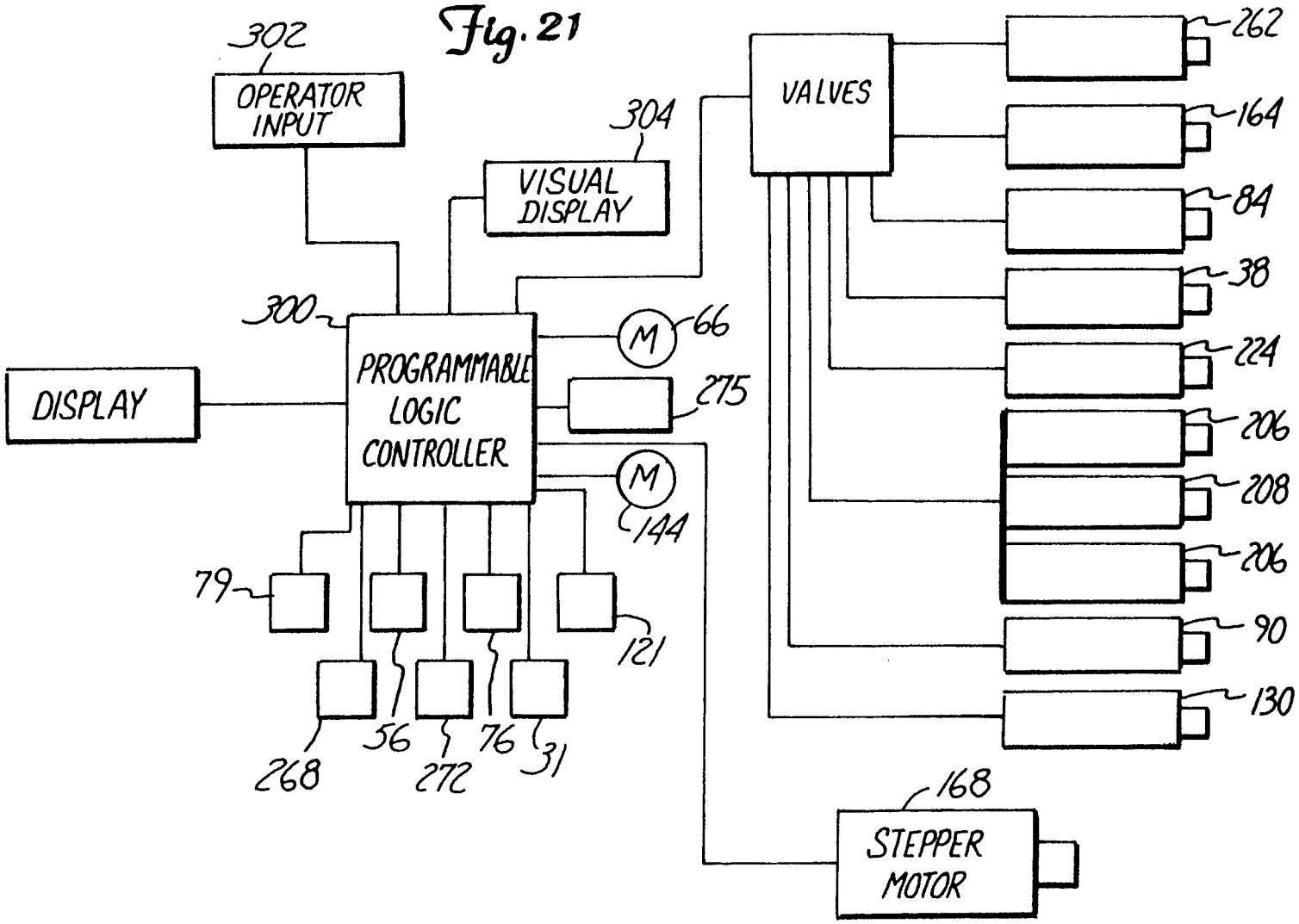
FIG. 21 is a schematic representation of a control arrangement of the present invention.

A preset sequence of operation is followed using a programmable logic controller or other available programmable control 300. The PLC is a conventional logic unit that includes a clock and can be programmed to provide outputs based on a wide variety of digital inputs, such as switch closings or encoders and is easily programmed for use. FIG. 21 provides a schematic representation in simplified form.

If the machine is coin operated, or credit-card operated, the money would have to have been inserted and the overall system powered or activated in a known manner.

The operator would select the type of grind that would be desired, whether it would be hollow or flat ground, and the type of skate also would be selected. An operator input 302 is represented for providing signals indicating selections. The PLC will provide feedback to a display 304 indicating what has been selected and what process is being carried out, in a conventional manner. In particular, a selection would be made between figure skates and hockey skates because figure skate blades have serrations at the front end which must be cleared by the grinding wheel in order to avoid damaging them.

After the unit is powered and a selection of grind and skate type has been made, the hydraulic pump assembly 275 (it includes a reservoir for fluid) is started for power. The dressing wheel cooling pump will be started, if desired, and the grinder motor 144 would start. The positive stop for the grinding assembly is moved down 0.003 inches by operation of the stepper motor 168 that moves stop member 176 the desired amount.

Depending on the selection of hollow ground or flat ground blade surfaces, the yoke carrying the grinding wheel dressing point would be either moved to the position shown in FIG. 15, or to the position shown in FIG. 17 (if needed), so that the proper grind would occur. The actuator 164 is also operated to pull on the yoke 160 and pull the grinding wheel assembly, including the housing 146 down against the positive stop 176.

The grinding wheel is powered by energizing the motor 144 driving the grinding wheel as stated, and if a coolant is used on the grinding wheel, the coolant pump would be started at the same time. The actuator 224 is operated to pivot the yoke to move the dressing point 220 across the surface of the grinding wheel 150 to dress the wheel edge as the point 220 is rotated. Two passes are made, that is a pass in one direction, and return, and then a second pass and a return. The controller used can be set to count the passes using a suitable sensor. Then the wheel dressing would stop by de-energizing the actuator 224 in a desired position.

The home position of the grinding wheel dressing yoke is sensed and signalled by an encoder or by a switch. After dressing the grinding wheel 150 the actuator 164 is returned to its up position to permit the grinding wheel to move upwardly under the counterbalance force ready to grind a skate blade. The wheel 150 continues to run.

The sliding door is opened by its actuator 262 so that access would be gained to the otherwise closed cabinet. At the same time that the door actuator 262 is operated, the skate support pad 94 is moved into position with the flanges 93 up against the bottom plates 108 of the swing arm assembly to properly position the support surface for the skate, which is the top surface of rib 95.

The skate boot and skate blade would then be inserted toe first into the space in the swing arm assembly with the toe inserted first. The tongue and laces are placed inside the boot, and an operator's prompt to do so would be displayed. The guides 100 guide the blade into position between the clamp jaws, and down against the rib of the support pad 94.

When the skate boot has been sensed with the sensor assembly utilized as shown at 54–56, a "skate present" signal will be provided to PLC 300 and used to actuate valves to cause the door to close by retractor actuator 262. This would prevent accidental or inadvertent tampering by or interference with an operator.

The skate centering assembly 22 for centering the skate blade longitudinally is moved down in position by operating the actuator 84, after which the motor 66 would be energized to center the skate in the open clamp jaws as held by pad 94, as previously described. The encoder 79 for the shaft of motor 66 provides a signal that indicates the length of the skate blade. Once the boot and blade are centered and the signal from microswitch 76 is received, the clamp jaws are closed by operating the actuator 38 and the linkage 46 to push on the struts 50 which in turn would operate the toggle linkages 110 to close the sliding jaws 106 and place the hardened jaw inserts 106A against the opposite sides of the skate blade.

When a signal indicates that the clamp jaws have closed, which can be obtained by sensing the travel of the jaws or the linkage with a sensor schematically shown at 121 (FIG. 7), the signal is used for operating actuator 90 to drop the skate blade support pad downwardly away from the blade. Also, the signal would be provided to motor 66 of the skate centering assembly to reverse and open the skate blade centering arms, and then after an interlocked signal operate actuator 84 to retract the skate blade centering assembly up out of the way.

If a figure skate has been selected, the grinding wheel is moved downwardly after the shaft encoder 31 on the shaft 30, which provides a series of pulses indicating the shaft position, and which is correlated with the encoding from the shaft on motor 66 indicating blade length, indicates when the toe end of the blade is about to engage the grinding wheel on the rearward (away from the door) or forward passes. Using the encoder, the location of the front end of the skate blade will be stored in the controller 300, and stored signals will indicate that after the shaft 30 has rotated a certain number of degrees the actuator 164 must be retracted to pull the grinding wheel away from the blade. The front serrated edge of the figure skate will not be ground off. The grinding wheel moves down to clear the serration and then back up.

The swing arm 18 will be operated by operating the actuator 130 through the cable drive, and will move the clamped skate back and forth over the grinding wheel. The number of times that the blade is ground can be controlled, but generally, including a final grind, maybe three cycles (three passes in each direction) will be used.

It should be also noted that the actuator 164 can be controlled to hold the grinding wheel at a horizontal position so that the grinding wheel does not continue to grind at the heel portion of the blade and at the toe portion of hockey skate blades. Many grinders put on an excessive curve at the heel and toe portions. In other words, the grinding wheel can be held to be generally horizontal throughout its stroke, and can be then retained in its position by operation the actuator 164 to a desired location correlated, again, to the position of the shaft 30 which is determined by the encoder. The skate blades do have a slight convexity which is accommodated in grinding by the counterweight bias.

The swing arm assembly 18 and the skate will be stopped adjacent the door 16 in the home position when the grind is competed, and this can be done merely by counting the number and direction of impulses from encoder 31 and bringing the swing arm back to its home position by operating the actuator 130. Limit switch also can be used.

When the grinding operation is done, the grinding wheel will be stopped, and the coolant (if any) will be stopped and the clamp jaws will be opened. The sliding door 16 will also open so that the skate can be removed. A second skate is inserted if a pair is to be ground. The sliding door 16 will close after a preset length of time after the sensors 54 and 56 no longer indicate that a skate boot is in position.

When both the skates are done the hydraulic pump will stop, and suitable lights or buttons can show that the cycle is completed.

The machine provides for precise grinding and operation. It can be programmed to suit the user and includes the needed mechanical controls and actuators for a wide variety of desired programs, prompts and other functions.

Although the present invention has been described with reference to preferred embodiments, workers skilled in the art will recognize that changes may be made in form and detail without departing from the spirit and scope of the invention.

What is claimed is:

1. A skate sharpening machine for sharpening the bottom edge of a blade of an ice skate, comprising a grinding wheel having a periphery;

a skate support positioned to move relative to the periphery of the grinding wheel;

a clamp for holding a skate in the skate support as the support moves relative to the grinding wheel while the grinding wheel engages the bottom edge of a skate blade of such skate; and means for dressing the grinding wheel periphery to a selected one of a plurality of desired cross-sectional configurations prior to moving the skate relative to the grinding wheel wherein the grinding wheel will engage the skate blade wherein said dressing means comprises a support, means to pivotally mount the support about an axis perpendicular to an axis of rotation of the grinding wheel at a known position relative to the periphery of the grinding wheel, a dressing member slidably mounted on the support for movement substantially radially of the pivot axis of the support, and a power operated control for changing the length of the radius of pivoting of said dressing member for use during dressing of the grinding wheel to obtain the plurality of different selectable cross-sectional shapes of the periphery of the grinding wheel and of the bottom of a skate blade being sharpened.

2. The machine of claim 1 wherein said clamp support includes a clamping member for clamping opposite side surfaces of the blade of an ice skate, said clamping member comprising transversely movable clamping jaws, and toggle linkage means directly aligned for movement along a plane transverse to the blade of an ice skate for actuating said clamping jaws by moving the clamping jaws toward and away from a centerline substantially corresponding to the centerline of a blade of an ice skate held in the skate support, and actuator means for moving said toggle linkage means between a clamped and an unclamped position.

3. The machine of claim 2 wherein said actuator means comprises a strut for said toggle linkage means, and wherein there is a separate toggle linkage means and strut on each side of the centerline of the blade, and a pivoting link assembly pivotally connected to ends of both of said struts opposite from the connection of the struts to the respective toggle linkage means, and the actuator means further comprising a link actuator for operating said pivoting link assembly to provide for compression and tension loading on said struts simultaneously as the link actuator is operated.

4. The machine of claim 3 wherein said link actuator is connected to the pivoting link assembly through a block having a pair of relatively movable members, and compression spring means between the members of the block whereby the clamping jaws may exert a clamping force by compressing the compression spring means between the movable members of said block.

5. The machine of claim 1 wherein said grinding wheel is mounted onto a shaft rotatably mounted in a housing, a drive motor for said grinding wheel support to move with said housing, a mounting pivot for mounting the housing with the mounting pivot positioned between the motor and the shaft and grinding wheel, the grinding wheel being counterbalanced by said motor about the pivot to provide a force urging the grinding wheel toward the clamp under gravity.

6. The machine of claim 1 wherein said skate support mounts on a pivot to pivot relative to the grinding wheel, and encoder means to determine the angular position of said skate support about said pivot, programmable logic controller means for receiving signals from the encoder indicating the position of the skate support for controlling selected operations as a function of the position of the skate support about its pivot.

7. The machine of claim 1 and a slidable mount for the support for shifting the pivotal mounting of the support along a radius of pivoting, and a support actuator for shifting the support to move the dressing member relative to the grinding wheel.

8. The machine of claim 7 and a grinding wheel actuator for pulling the grinding wheel and motor assembly toward the dressing member for dressing the wheel, and an adjustable stop member to locate the periphery of the grinding wheel at known locations relative to the dressing member.

9. The machine of claim 8 wherein said adjustable stop member comprises a screw threaded member and a stepper motor to drive the screw threaded member a selected amount after dressing the grinding wheel with the dressing member.

10. The machine of claim 8 and means to simultaneously operate the dressing member actuator and the yoke actuator to operate an end of the dressing member engageable with the dressing wheel at a substantially identical position in relation to the stop member.

11. A skate sharpening machine for sharpening the bottom edge of a skate blade of an ice skate, comprising:

a frame;

a grinding wheel having a peripheral edge;

a skate support mounted on the frame and movable in a path at a predetermined relationship to the periphery of the grinding wheel;

a clamp for holding a skate in the skate support as the support moves relative to the grinding wheel, the skate being clamped in position wherein the grinding wheel engages the bottom side of a skate blade of such skate;

a wheel dressing member slidable mounted on a wheel dressing member support, the wheel dressing member support being pivotally mounted on the frame about an axis perpendicular to an axis of rotation of the grinding wheel at a known position relative to the peripheral edge of the grinding wheel and the wheel dressing member being mounted for movement substantially radially relative to the pivot axis of the wheel dressing member support; and a power operated actuator for selectively changing the length of the radius of pivoting of said wheel dressing member for use during dressing of the grinding wheel to obtain a plurality of different selectable cross-sectional shapes of the grinding wheel and of the bottom of a skate blade being sharpened.

12. The machine of claim 11 wherein said grinding wheel is mounted onto a shaft rotatably mounted in a housing, a drive motor for said grinding wheel supported to move with said housing, a mounting pivot for mounting the housing with the mounting pivot positioned between the motor and the shaft and grinding wheel, the grinding wheel being counterbalanced by said motor under gravity about the pivot, to provide a force sufficient to urge the grinding wheel toward the clamp about the pivot.

13. The machine of claim 12 and a grinding wheel actuator for pulling the grinding wheel and motor assembly toward the dressing member for dressing the grinding wheel, and an adjustable stop to locate the periphery of the grinding wheel at known locations relative to the dressing member.

* * * * *

UNITED STATES PATENT AND TRADEMARK OFFICE

CERTIFICATE OF CORRECTION

PATENT NO. : 5,287,657

DATED : February 22, 1994

INVENTOR(S) : RUDOLPH R. TSCHIDA; DONALD NORQUAL

It is certified that error appears in the above-identified patent and that said Letters Patent is hereby corrected as shown below:

Col. 16, line 21, delete "slidable", insert --slidably--

Signed and Sealed this

Twenty-sixth Day of July, 1994

*Attest:*

Bruce Lehman

BRUCE LEHMAN

*Attesting Officer*

*Commissioner of Patents and Trademarks*